US007565852B2

(12) United States Patent
Yu

(10) Patent No.: US 7,565,852 B2
(45) Date of Patent: Jul. 28, 2009

(54) SCREWDRIVER WITH ROTARY CARTRIDGE INCLUDING REPLACEABLE BITS THEREIN

(75) Inventor: Hong-Chow Yu, No. 28, Lane 157, Yong Hsin Rd., Ta Li City, Taichung Hsien (TW)

(73) Assignees: Hong-Chow Yu, Taichung Hsien (TW); Kae Mae Enterprise Co., Ltd., Taichung Hsien (TW)

( * ) Notice: Subject to any disclaimer, the term of this patent is extended or adjusted under 35 U.S.C. 154(b) by 0 days.

(21) Appl. No.: 12/009,726

(22) Filed: Jan. 22, 2008

(65) Prior Publication Data

US 2008/0190249 A1 Aug. 14, 2008

(30) Foreign Application Priority Data

Feb. 12, 2007 (TW) ..... 96105082 A

(51) Int. Cl.
*B25G 1/08* (2006.01)

(52) U.S. Cl. ..... 81/177.4; 81/177.1; 81/439; 81/440; 81/490

(58) Field of Classification Search ..... 81/177.1, 81/177.4, 439, 440, 490
See application file for complete search history.

(56) References Cited

U.S. PATENT DOCUMENTS 6,502,484 B2 * 1/2003 Pao-Hsi ..... 81/439
7,039,975 B1 * 5/2006 Liao ..... 7/165
7,237,458 B2 * 7/2007 Shiao ..... 81/62

* cited by examiner

*Primary Examiner*—Joseph J Hail, III
*Assistant Examiner*—Shantese McDonald
(74) *Attorney, Agent, or Firm*—Pro-Techtor Int'l Services; Ralph Willgohs

(57) ABSTRACT

A screwdriver with rotary cartridge including replaceable bits therein comprises a body including a cavity portion formed at one end thereof for receiving a rotary cartridge having grooves therein, the cavity portion including a mounting tube provided at front end thereof and communicating therewith, the grooves rotatably corresponding to the mounting tube, the cavity portion also including a slide seat secured at the rear end thereof and communicating therewith, the slide seat including a grip disposed thereon and having a push shank fixed at the front end thereof, wherein a slidable piece is attached in the cavity portion for being pushed by the push shank and includes a guide slot formed thereon, at one end of the rotary cartridge are extendedly defined with locking protrusions, on a rotating shaft of the rotary cartridge is pivotally secured an actuation member for rotatably retaining the corresponding locking protrusions, the actuation member includes a guiding tab disposed thereon for being fitted in the guide slot.

11 Claims, 17 Drawing Sheets

SCREWDRIVER WITH ROTARY CARTRIDGE INCLUDING REPLACEABLE BITS THEREIN

BACKGROUND OF THE INVENTION

1. Field of the Invention

The present invention relates to a screwdriver with rotary cartridge including replaceable bits therein, an actuation member of which is actuated to rotatably retain locking protrusions by using a guiding tab, and then a rotary cartridge is urged to rotate so that the next groove may correspond to a mounting tube, such that the rotary cartridge may be automatically rotated for replacing the bits.

2. Description of the Prior Arts

Referring FIGS. 1 and 2, Taiwan Patent No. 94121696 discloses a convention screwdriver with rotary cartridge including replaceable bits therein comprising a body 10 including a cavity portion 11 formed therein, the cavity portion 11 including a mounting tube 12 provided at the front end thereof and communicating therewith, and a connecting block 111 extendedly disposed on a side thereof for pivotally coupling with a receiving member 13 so that the receiving member 13 is received in the cavity 11, and the receiving member 13 including a positioning stem 131 mounted at each of two side plates thereof for pivotally connecting with a rotary cartridge 14 including a plurality of grooves formed therein, the rotary cartridge 14 extending out of the body 10 and allowing to be rotated by user, the grooves 141 of the rotary cartridge 14 notably corresponding to the mounting tube 12, and the cavity 11 of the body 10 also including a cylindrical member 15 fixed at the rear end thereof and communicating therewith, the cylindrical member 15 including a grip 16 having a push shank 161 attached at the external portion thereof, and the push shank 161 including a magnetic member 162 fixed at the end portion thereof and received in the cylindrical member 15.

As shown in FIG. 3, in the operation of screwdriver, the grip 16 is pushed forward so that the push shank 161 slidably pushes the bit in the rotary cartridge 14 of the groove 141 to the mounting tube 12 such that the user may assemble or disassemble workpiece. As shown in FIG. 4, as desiring to replace bit, the grip 16 is moved rearward, and the magnetic member 162 attaches the bit to move rearward simultaneously so that the bit may be stored in the groove 141 and the rotary cartridge 14 rotates to select the desired bit, and then the grip 16 is moved forward for pushing the bit out of the mounting tube 12, however, such a conventional screwdriver still has the following disadvantages:

1. As replacing the bit, the grip 16 is moved rearward so that the bit is stored in the groove 141, yet in the meantime, the user has to rotate the rotary cartridge 14 by hand to select the desired bit, and then the grip 16 is moved forward for pushing the bit out of the mounting tube 12, such a manual operation is quite inconvenient for the user.

2. The rotary cartridge 14 extends out of the body 10, thus decreasing the aesthetic appearance of the screwdriver.

The present invention has arisen to mitigate and/or obviate the afore-described disadvantages.

SUMMARY OF THE INVENTION

The primary objective of the present invention is to provide a screwdriver with rotary cartridge including replaceable bits therein comprises a body including a cavity portion formed at one end thereof for receiving a rotary cartridge having a plurality of grooves therein, the cavity portion including a mounting tube provided at front end thereof and communicating therewith, the grooves rotatably corresponding to the mounting tube, the cavity portion also including a slide seat secured at the rear end thereof and communicating therewith, the slide seat including a grip disposed thereon and having a push shank fixed at the front end thereof, wherein a slidable piece is attached in the cavity portion for being pushed by the push shank and includes a guide slot formed thereon, at one end of the rotary cartridge are extendedly defined with a plurality of locking protrusions, on a rotating shaft of the rotary cartridge is pivotally secured an actuation member for rotatably retaining the corresponding locking protrusions, the actuation member includes a guiding tab disposed thereon for being fitted in the guide slot, hence as the push shank pushes the slidable piece to move forward and rearward, the actuation member is actuated to rotatably retain the locking protrusions by using the guiding tab, and then the rotary cartridge is urged to rotate so that the next groove corresponds to the mounting tube, such that the rotary cartridge may be automatically rotated for replacing the bits.

Another objective of the present invention is to provide a screwdriver with rotary cartridge including replaceable bits therein that the rotary cartridge may be received in the cavity portion of the body so as to obtain the aesthetic appearance of the screwdriver.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
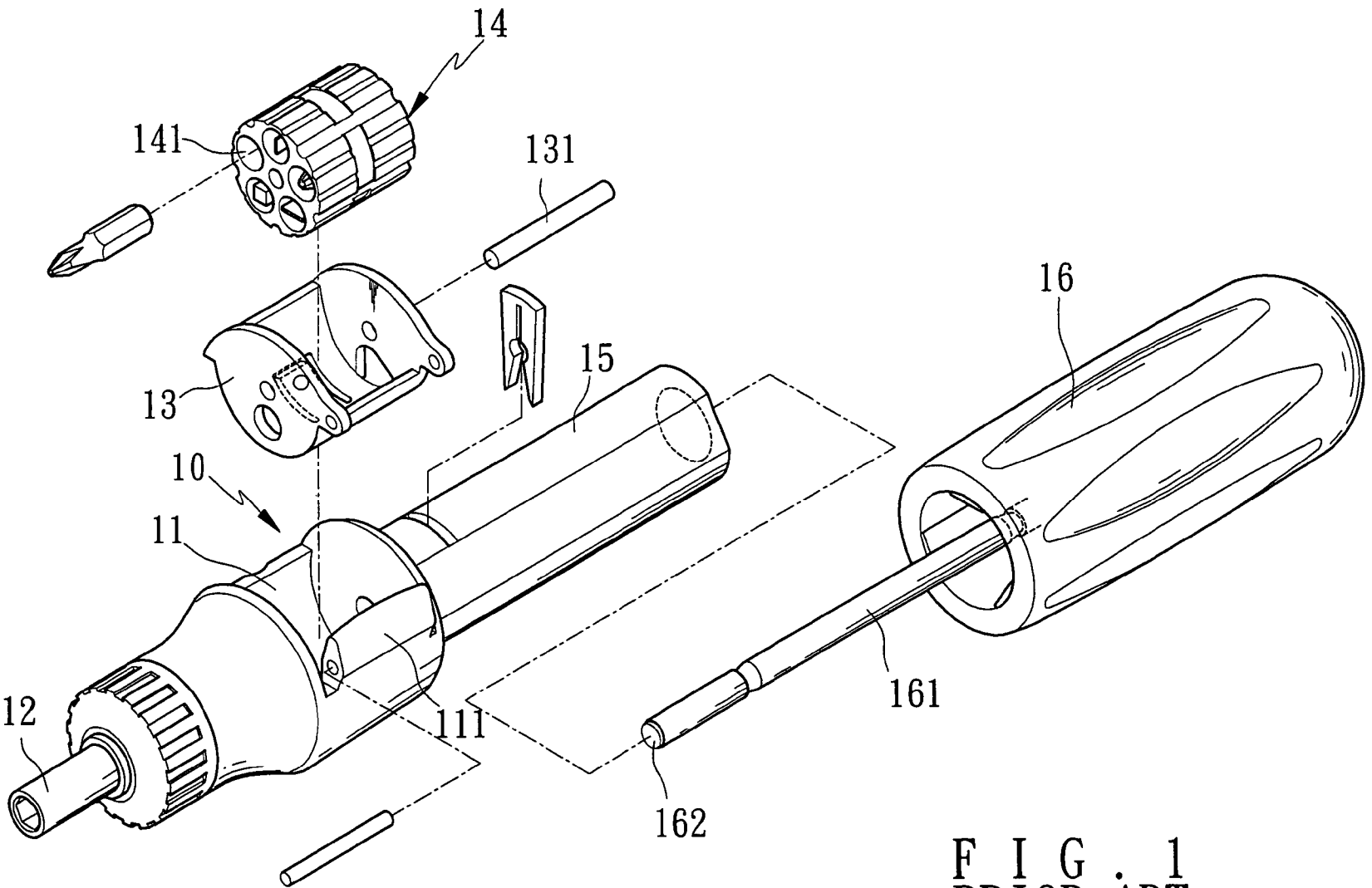
FIG. 1 PRIOR ART
FIG. 1 is an exploded view of Taiwan Patent No. 94121696.
Figure 2:
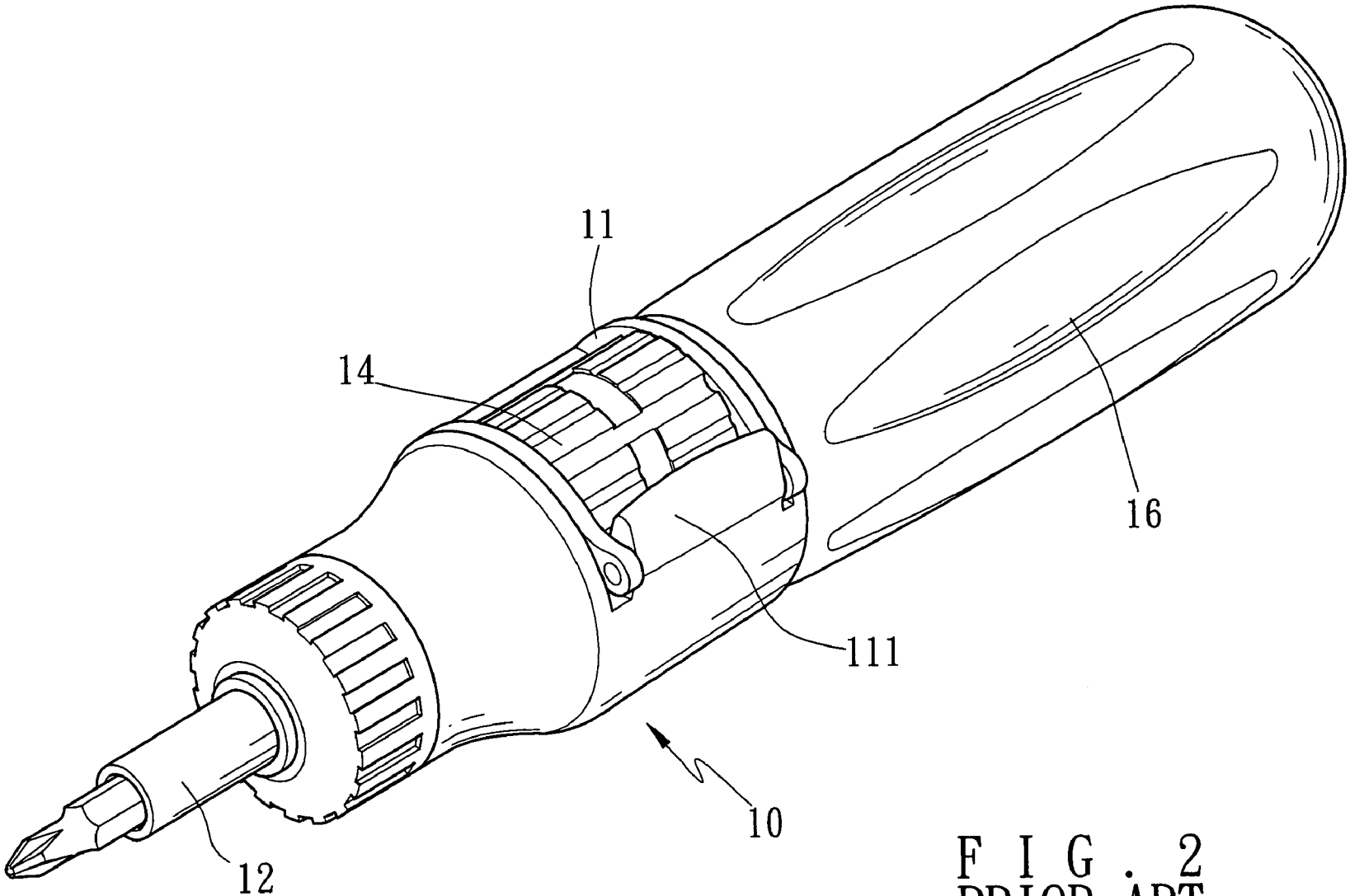
FIG. 2 PRIOR ART
FIG. 2 is a perspective view of Taiwan Patent No. 94121696.
Figure 3:
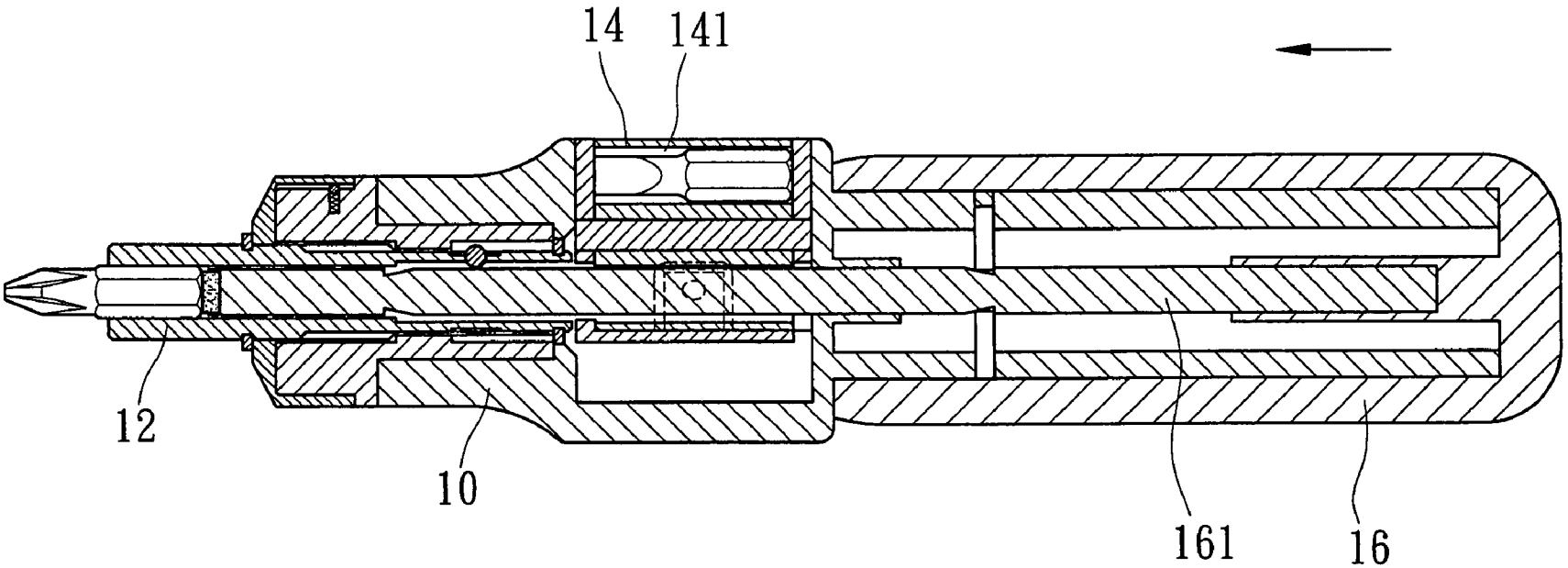
FIG. 3 PRIOR ART
FIG. 3 is an operational view of Taiwan Patent No. 94121696.
Figure 4:
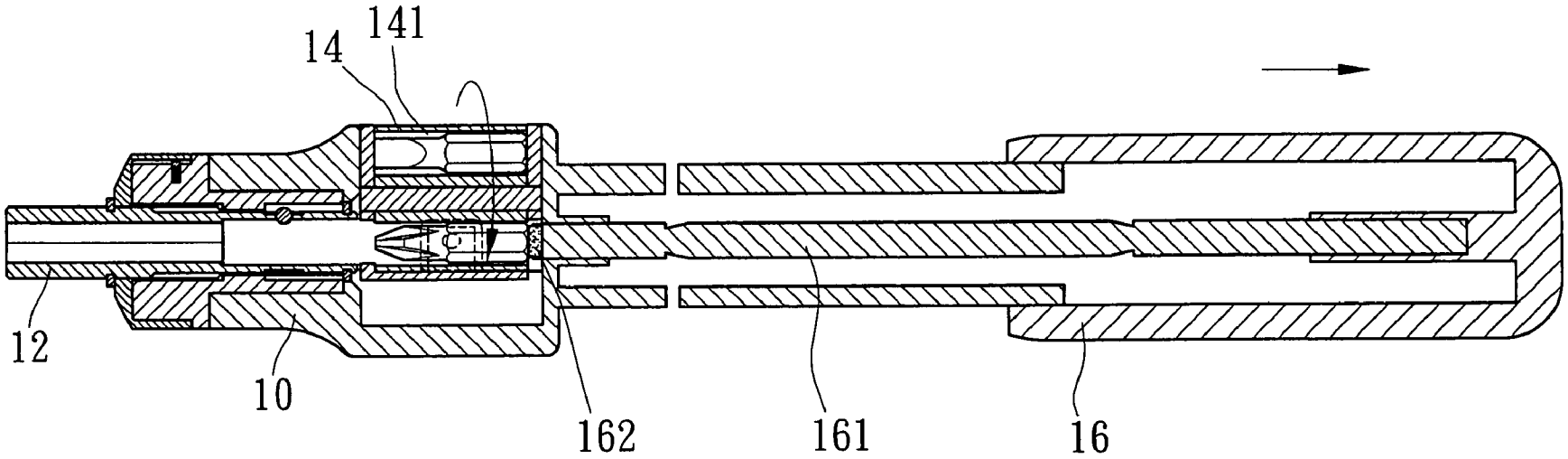
FIG. 4 PRIOR ART
FIG. 4 is also an operational view of Taiwan Patent No. 94121696.
Figure 5:
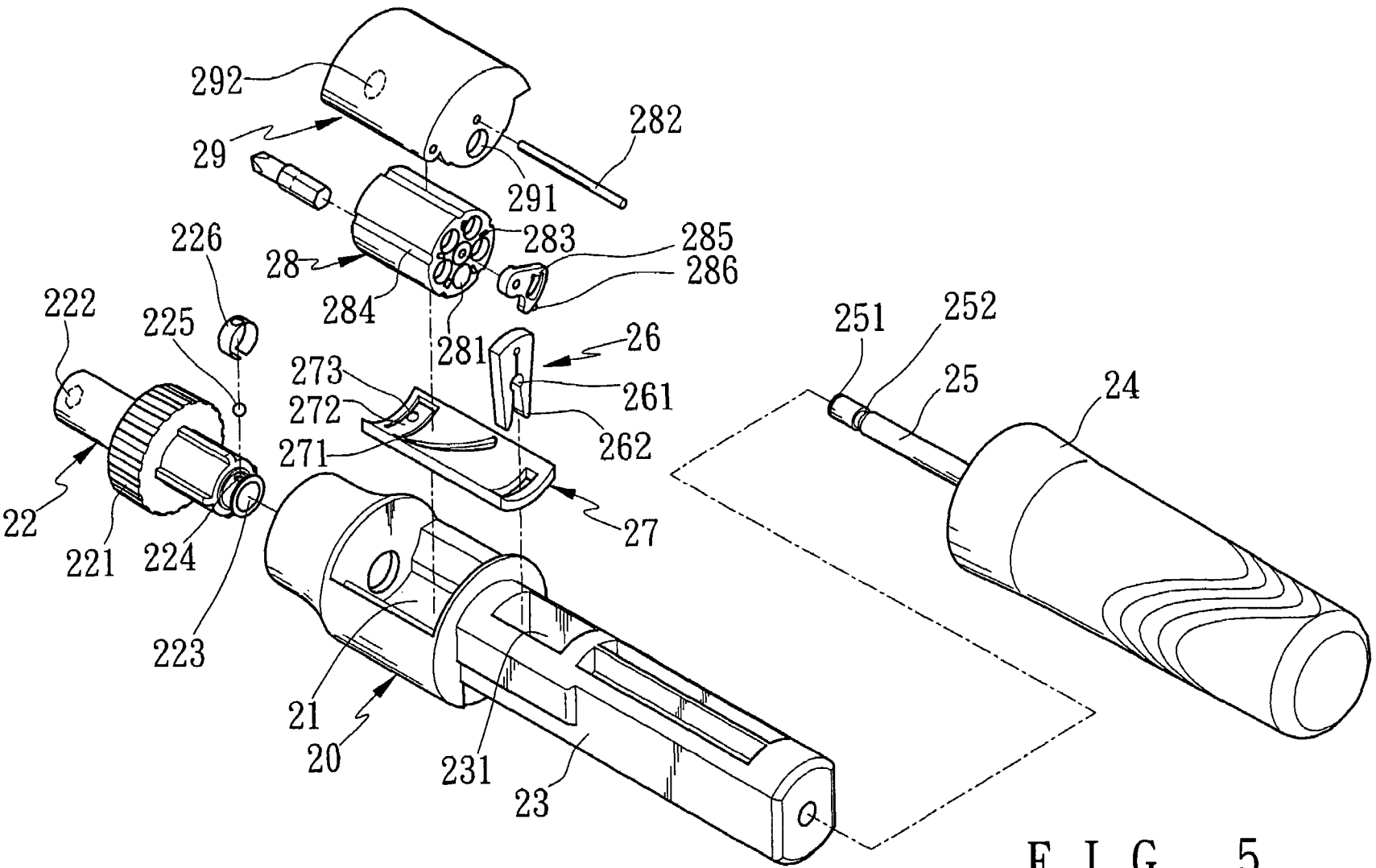
FIG. 5 is an exploded view of a screwdriver with rotary cartridge including replaceable bits therein in accordance with the present invention.
Figure 6:
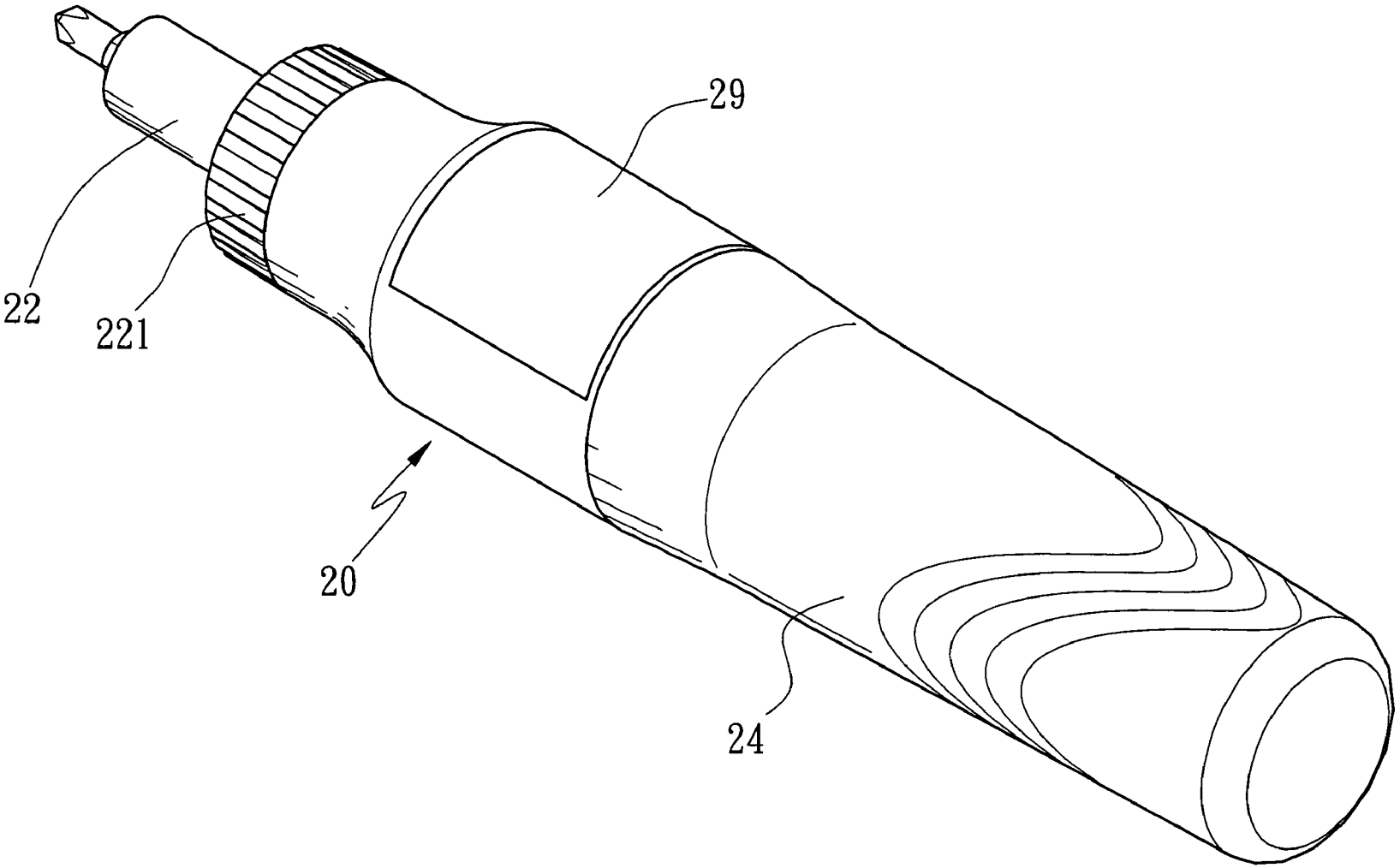
FIG. 6 is a perspective view of the screwdriver with rotary cartridge including replaceable bits therein in accordance with the present invention.
Figure 7:
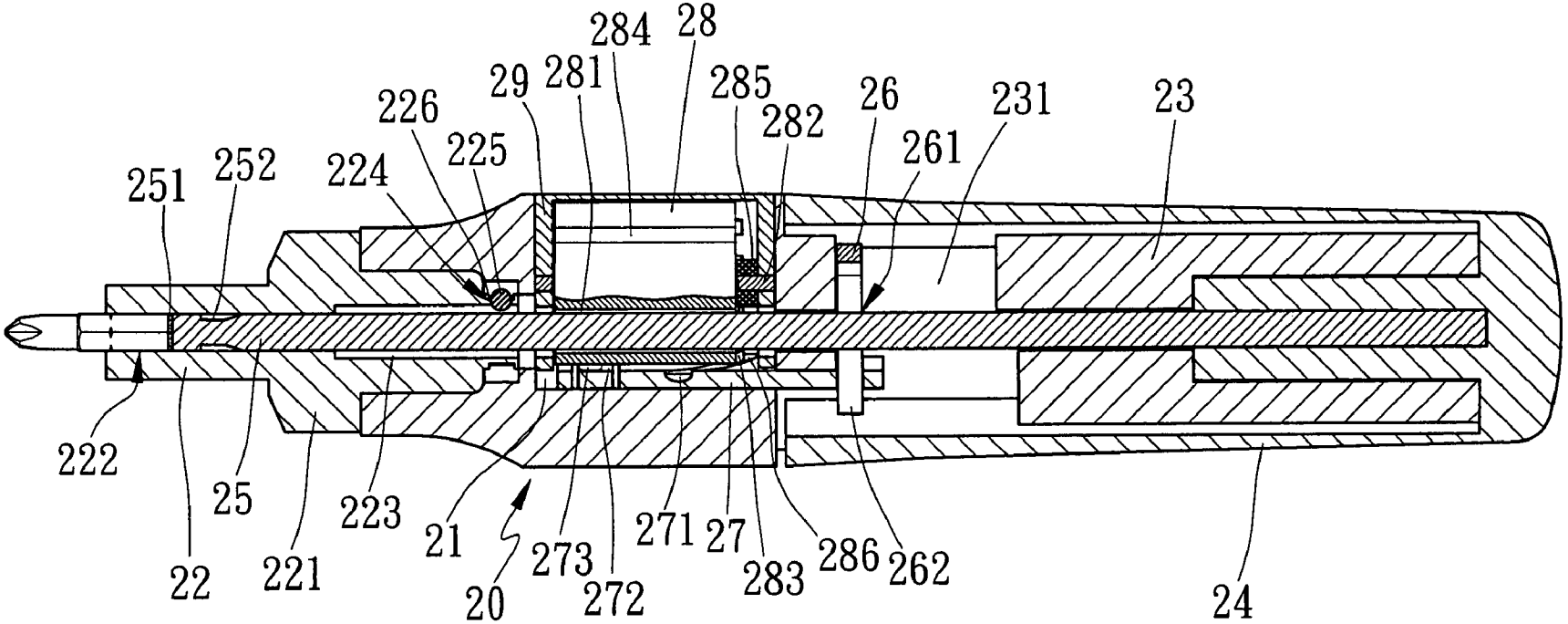
FIG. 7 is a cross sectional view of the screwdriver with rotary cartridge including replaceable bits therein in accordance with the present invention.

Referring to FIGS. 5-7, a screwdriver with rotary cartridge including replaceable bits therein in accordance with the present invention comprises a body 20 including a cavity portion 21 formed at one end thereof, the cavity portion 21 including a mounting tube 22 provided at front end thereof and communicating therewith, the mounting tube 22 including a ratchet block 221 fixed around the outer periphery thereof, a polygon-bore segment 222 arranged at the front end thereof, and a circular-bore segment 223 formed at the rear end thereof and communicating with the cavity portion 21, wherein the circular-bore segment 223 includes a guiding device in response to the flat position of the polygon-bore segment 222, the guiding device includes a hole 224 provided in the mounting tube 22 and not passing through the circular-bore segment 223, the hole 224 includes a ball 225 mounted therein by an annular piece 226 such that the ball 225 resiliently extends into the circular-bore segment 223 and corresponds to the flat position of the polygon-bore segment 222. Furthermore, the cavity portion 21 also includes a slide seat 23 secured at the rear end thereof and communicating therewith, and the slide seat 23 includes a grip 24 disposed thereon and having a push shank 25 fixed at the front end thereof, the push shank 25 includes a magnetic block 251 provided at the end portion thereof, between the push shank 25 and the slide seat 23 is formed a confining structure which includes a recess 252 defined at a predetermined position of the front end of the push shank 25 and having a stop plane formed at the front end thereof and a guide plane formed at the rear end thereof, on the slide seat 23 is arranged a confining chamber 231 in which a limiting member 26 having a locking portion 261 and a hooking portion 262 is received, the locking portion 261 is retained in the recess 252 of the push shank 25. While the push shank 25 is moved rearward, the stop plane at the front end of the recess 252 urges the limiting member 26 to slidably move rearward in the confining chamber 231 of the slide seat 23, and then the limiting member 26 biases against the side wall at the rear end of the confining chamber 231 so that the push shank 25 is limited in the slide seat 23, yet while the push shank 25 is pushed forward, the limiting member 26 is urged to slidably move forward, and it biases against the side wall at the front end of the confining chamber 231, then the push shank 25 disengages from the locking portion 261 of the limiting member 26 by using the guide plane at the rear end of the recess 252 to push the locking portion 261 so as to keep on moving forward. A slidable piece 27 includes a guide slot 271 and a resilient piece 272 having a retaining boss 273 formed thereon, and is attached in the cavity portion 21, one end of the slidable piece 27 extends into the confining chamber 231 of the slide seat 23 and engages with the hooking portion 262 of the limiting member 26 such that as the push shank 25 pushes the limiting member 26, the slidable piece 27 is driven to slidably move forward and rearward. A rotary cartridge 28 which includes a plurality of grooves 281 provided therein is pivotally fixed in a receiving member 29 by using a rotating shaft 282. The receiving member 29 includes through openings 291 and 292 formed at two ends thereof respectively and corresponding to the mounting tube 22, and the grooves 281 of the rotary cartridge 28 rotatably correspond to the through holes 291, 292 and the mounting tube 22, wherein at one end of the rotary cartridge 28 are extendedly defined with a plurality of locking protrusions 283, each including an inclined plane formed thereon, and on the outer side thereof are provided with a plurality of retaining slots 284 for rotatably retaining the corresponding retaining boss 273, on the rotating shaft 282 is pivotally secured an actuation member 285 for rotatably retaining one of the corresponding locking protrusions 283, the actuation member 285 includes a guiding tab 286 disposed thereon for being fitted in the guide slot 271 of the slidable piece 27.

Figure 8:
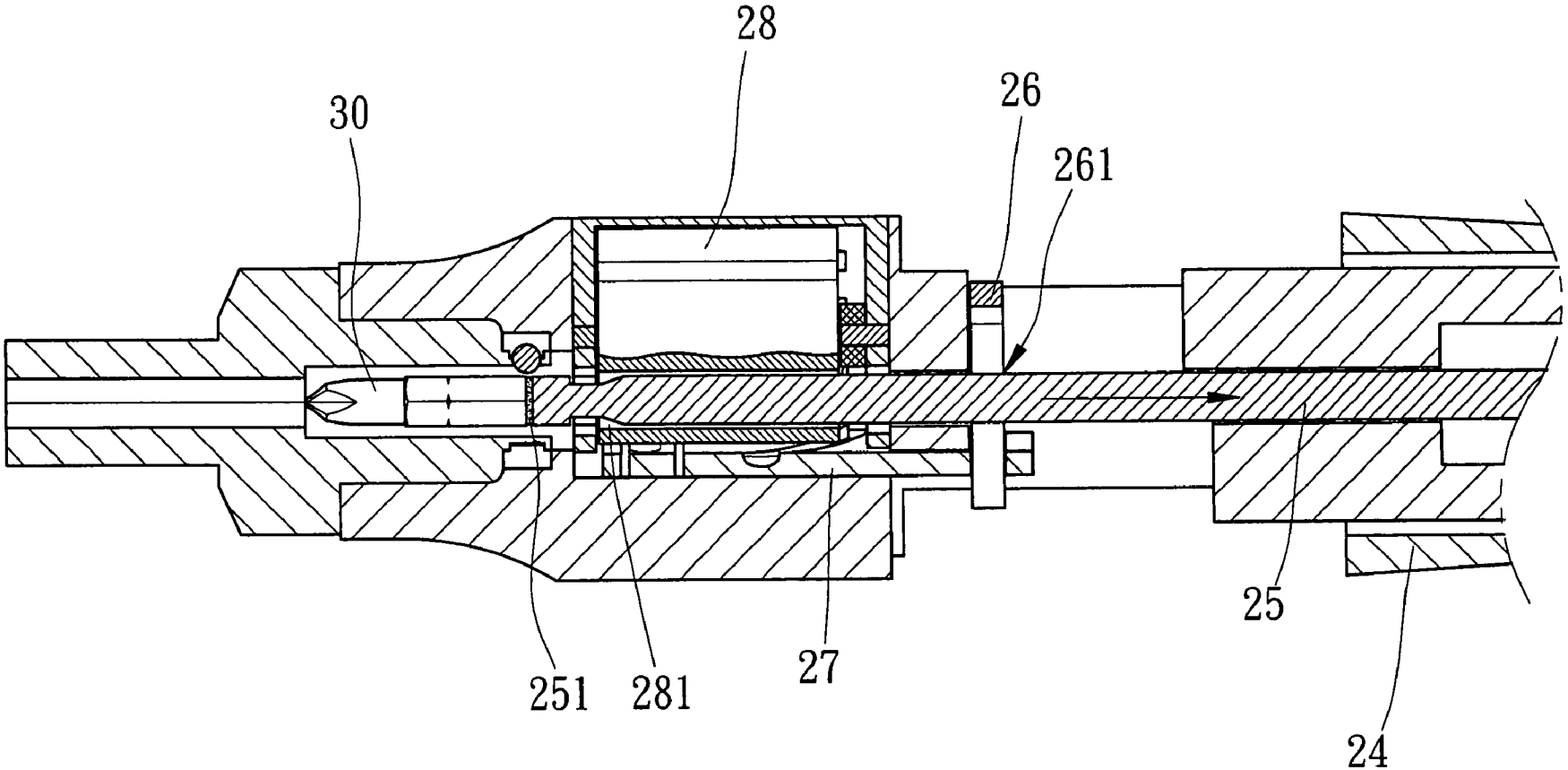
FIG. 8 is a cross sectional view illustrating the bit replacement of the present invention.
Figure 9:
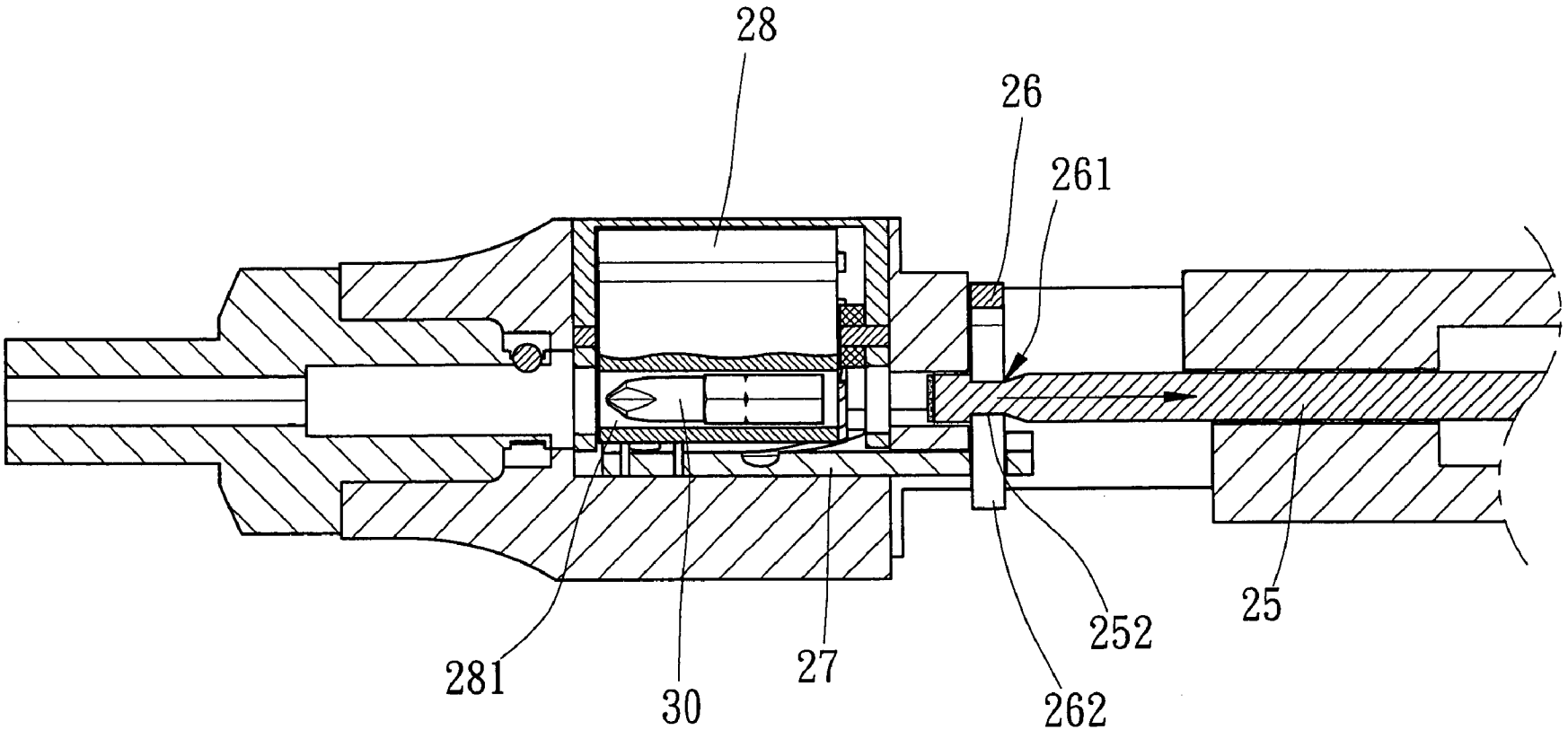
FIG. 9 is a further cross sectional view illustrating the bit replacement of the present invention.
Figure 10:
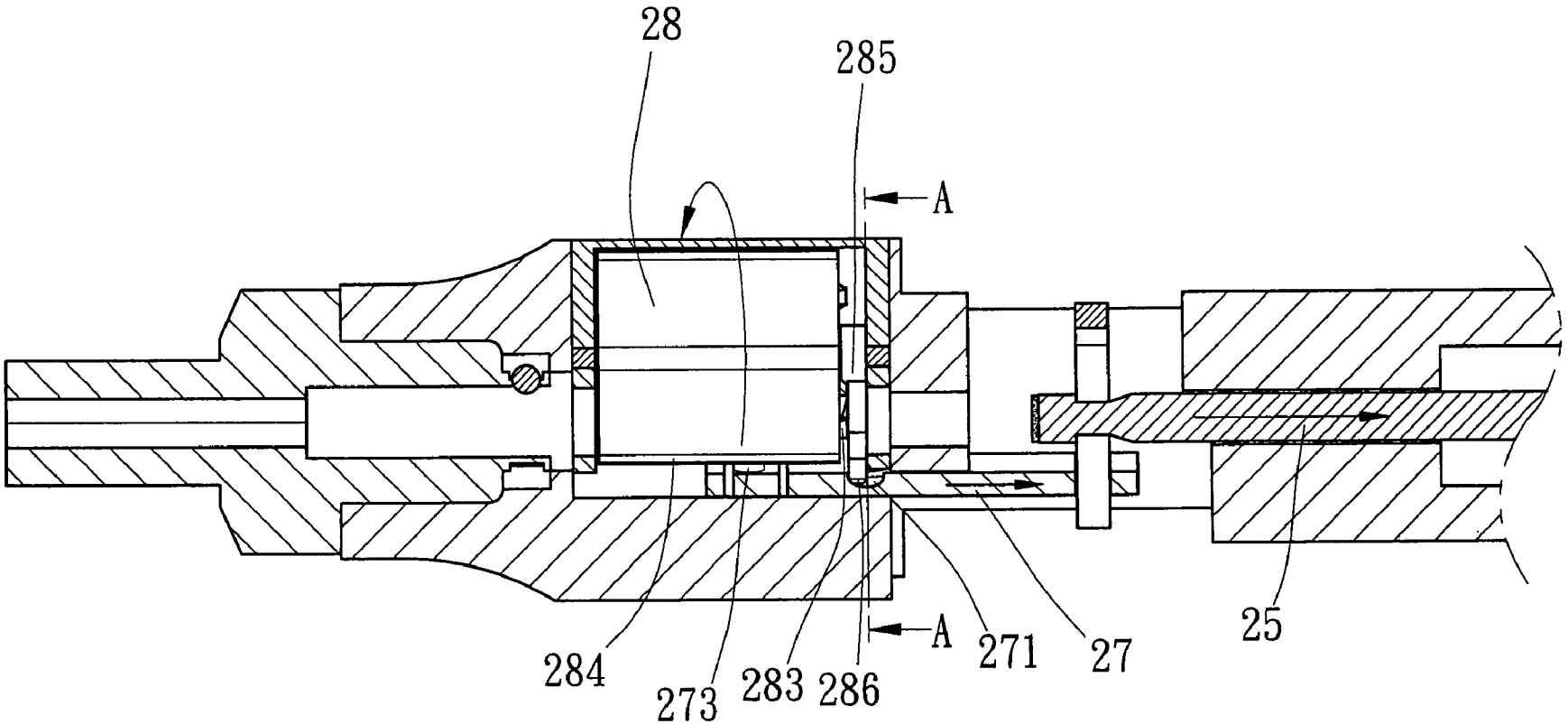
FIG. 10 is another cross sectional view illustrating the bit replacement of the present invention.
Figure 11:
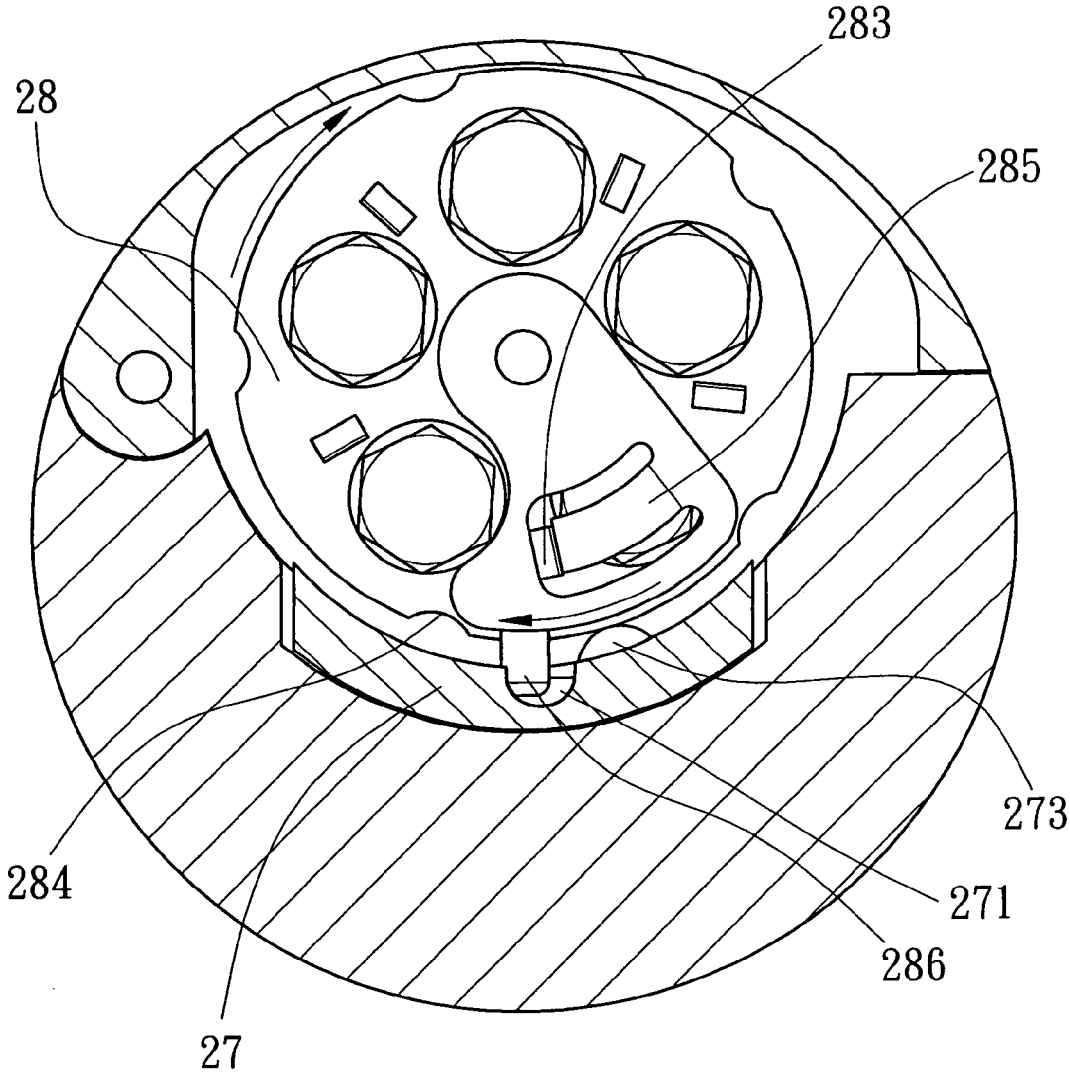
FIG. 11 is a cross sectional view of the screwdriver with rotary cartridge including replaceable bits therein, taken along lines A-A of FIG. 10.
Figure 12:
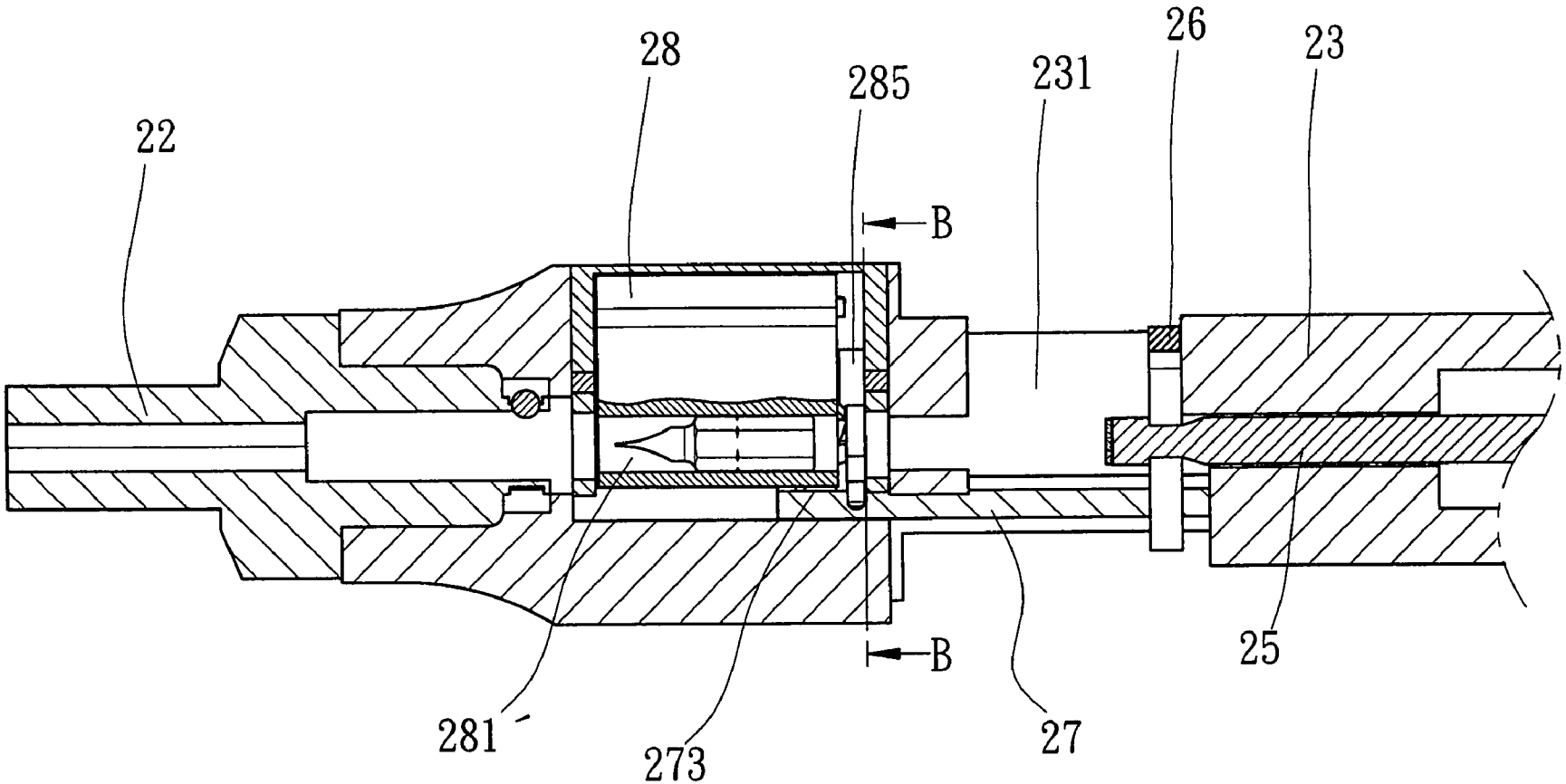
FIG. 12 is yet a further cross sectional view illustrating the bit replacement of the present invention.
Figure 13:
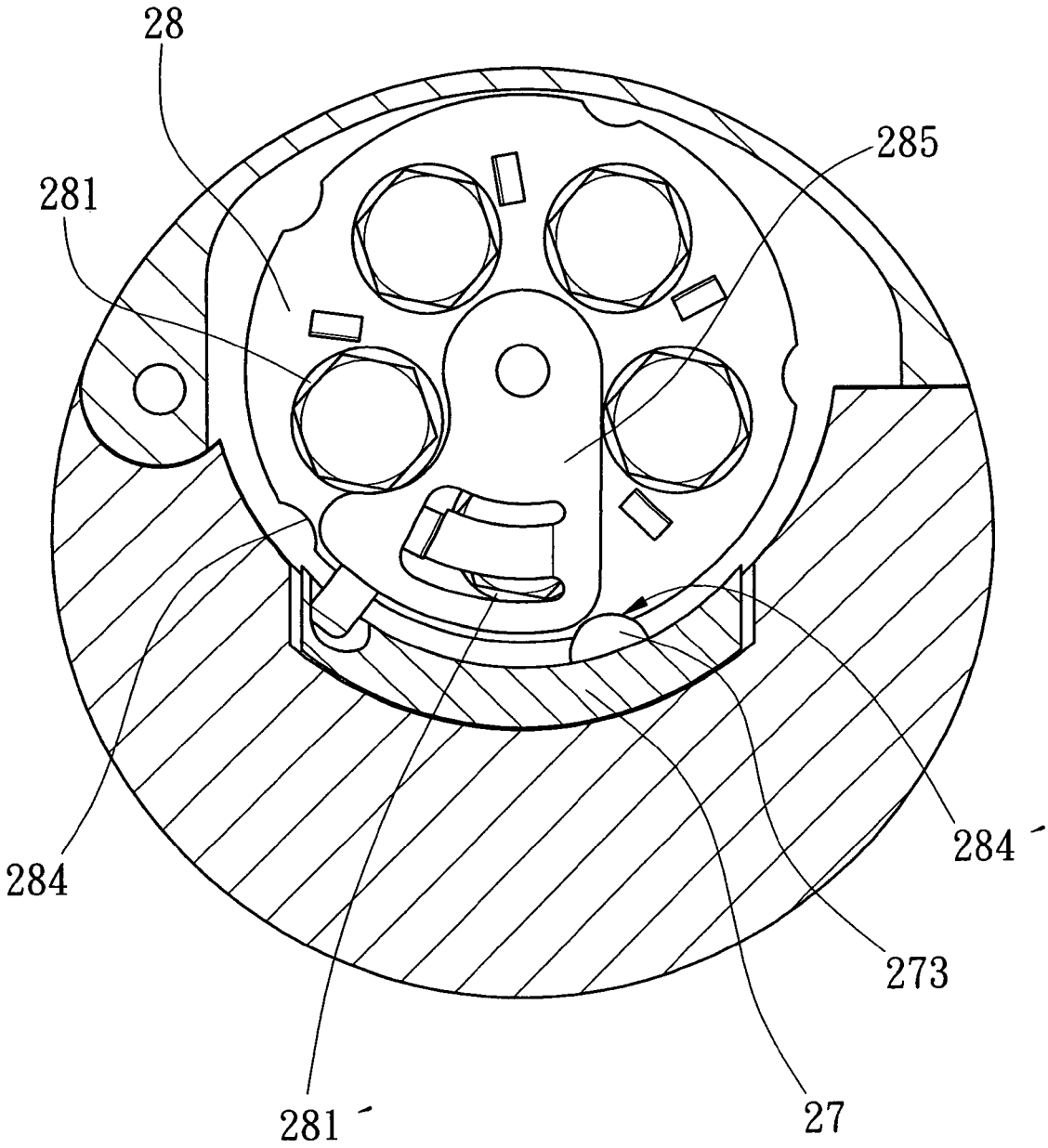
FIG. 13 is a cross sectional view of the screwdriver with rotary cartridge including replaceable bits therein, taken along lines B-B of FIG. 12.
Figure 14:
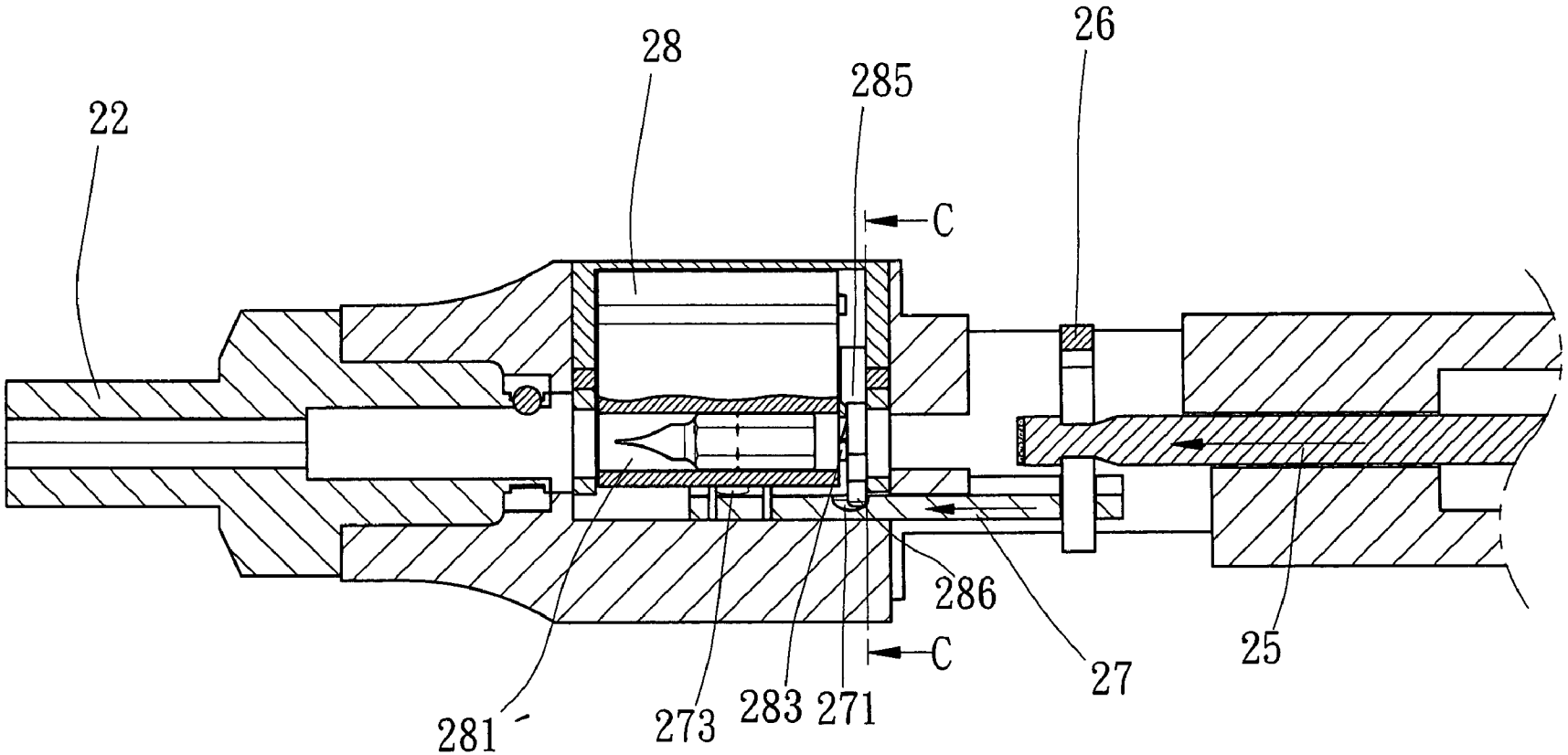
FIG. 14 is also another cross sectional view illustrating the bit replacement of the present invention.
Figure 15:
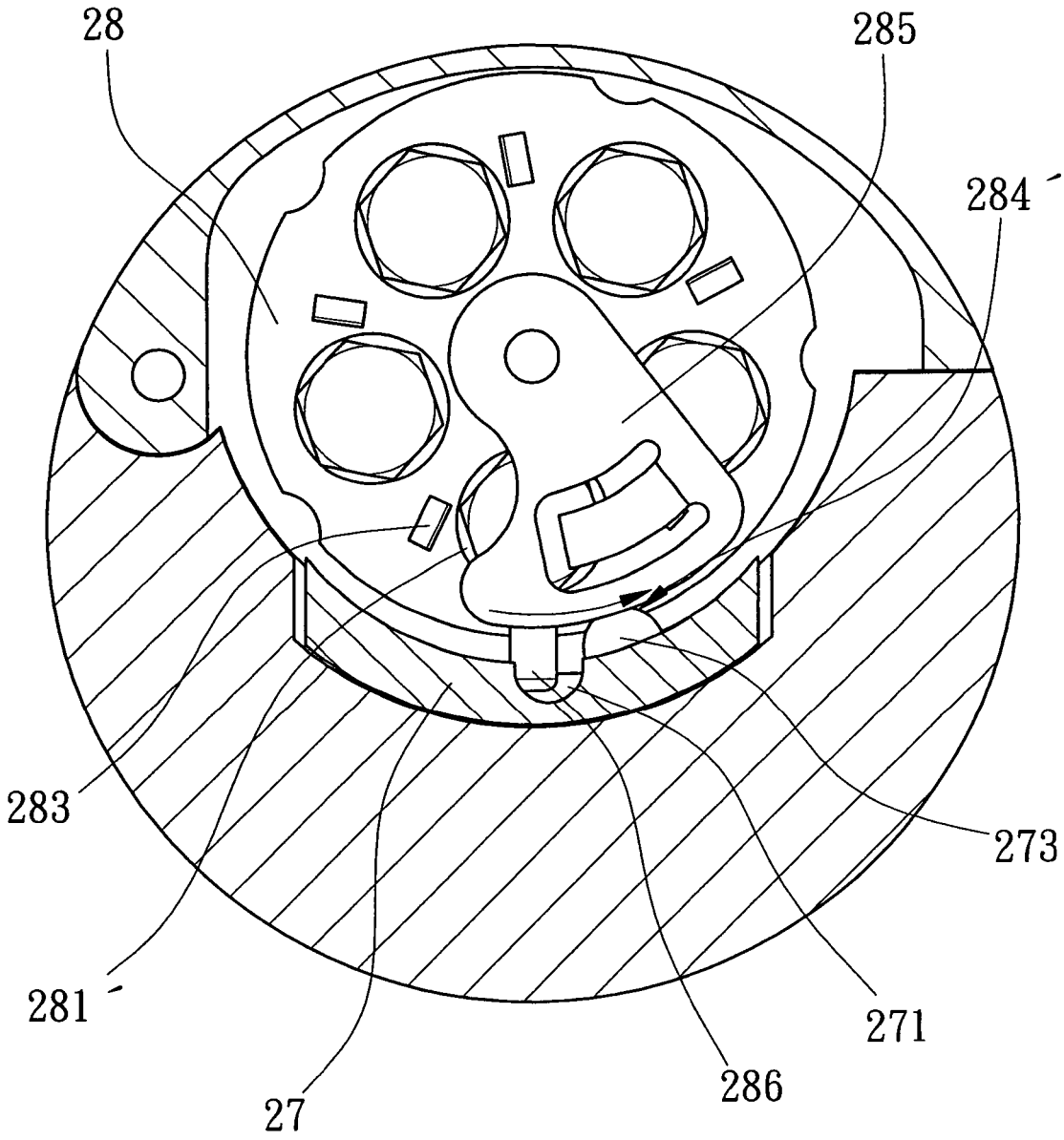
FIG. 15 is cross sectional view of the screwdriver with rotary cartridge including replaceable bits therein, taken along lines C-C of FIG. 14.
Figure 16:
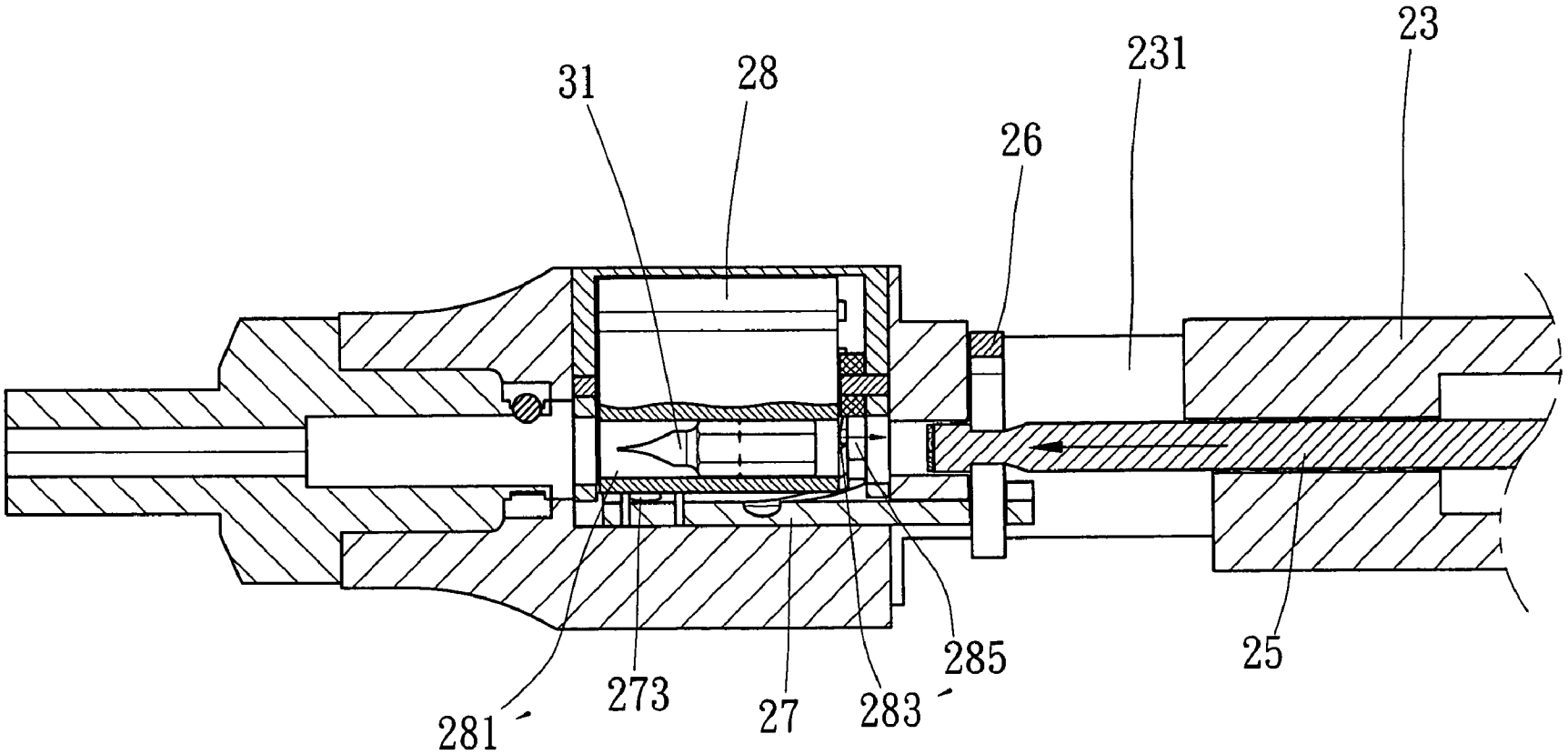
FIG. 16 is still a further cross sectional view illustrating the bit replacement of the present invention.
Figure 17:
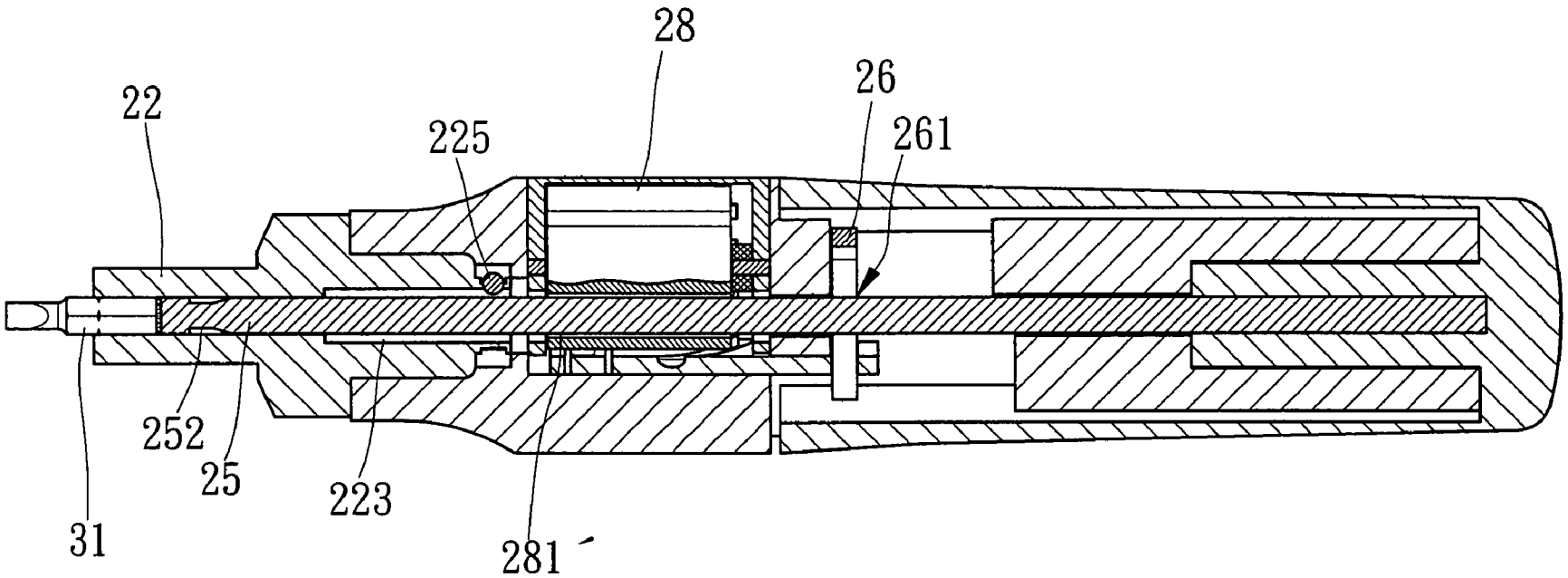
FIG. 17 is another cross sectional view illustrating the bit replacement of the present invention.

As shown in FIG. 8, in the operation of replacing bits, the grip 24 urges the push shank 25 to move rearward, and the magnetic block 251 attaches one of bits 30 to move rearward simultaneously, because the push shank 25 and the locking portion 261 of the limiting member 26 are in a disengaging state, the push shank 25 doesn't drive the limiting member 26 and the slidable piece 27 to move rearward, and the push shank 25 remains in one of the grooves 281 of the rotary cartridge 28, such that the rotary cartridge 28 will not be rotated. Referring to FIG. 9, as the push shank 25 keeps on moving rearward, the bit 30 is received in the initial groove 281 of the rotary cartridge 28, thereby the push shank 25 is disengaged from the rotary cartridge 28, and as the recess 252 of the push shank 25 moves to the limiting member 26, the locking portion 261 of the limiting member 26 engages with the recess 252 so as to urge the limiting member 26 to move rearward and to urge the slidable piece 27 which engages with the hooking portion 262 of the limiting member 26 to move rearward. With reference to FIGS. 10 and 11, while the push shank 25 actuates the slidable piece 27 to move rearward, the guide tab 286 in the guide slot 271 moves along the guide slot 271, and by using it to urge the actuation member 285 to rotate in a clockwise direction, the rotary cartridge 28 is urged to rotate, such that the retaining slot 284 and the retaining boss 273 release from the engagement. As illustrated in FIGS. 12-13, as keeping on moving the push shank 25 rearward and urging the actuation member 285 to move in the clockwise direction, the next groove 281' of the rotary cartridge 28 is in response to the mounting tube 22, and the next retaining slot 284' is retained simultaneously by the retaining boss 273, the limiting member 26 abuts against the side wall at the rear end of the confining chamber 231 so as to stop the push shank 25 moving rearward. As shown in FIGS. 14-15, as the push shank 25 is pushed forward, the limiting member 26 and the slidable piece 27 also move forward, and the guiding tab 286 in the guide slot 271 displaces along the guide slot 271, and the actuation member 285 is urged to rotate in an anticlockwise direction by using the guiding tab 286 and disengages from the locking portion 283 of the rotary cartridge 28, because the retaining slot 284 is retained by the retaining boss 273, the rotating actuation member 285 will not urge the rotary cartridge 28 to rotate, such that the next groove 281' remains corresponding to the mounting tube 22. Referring to FIG. 16, as the push shank 25 keeps on pushing forward, the actuation member 285 continues rotating in the anticlockwise direction, as it rotates to the next locking protrusion 283', due to the retaining slot 284 is retained by the retaining boss 273, the inclined plane of the next locking protrusion 283' is provided to push against the actuation member 285 to pass across the next locking protrusion 283', and the limiting member 26 contacts with the side wall at the front end of the confining chamber 231, thereby the limiting member 26 and the slidable piece 27 may not be moved forward. As shown in FIG. 17, keeping on pushing the push shank 25 forward, and by using the guide plane of the recess 252 to push the locking portion 261 of the limiting member 26, the push shank 25 disengages from the limiting member 26 and continuously moves forward so that another bit 31 in the next groove 281' of the rotary cartridge 28 is moved to the mounting tube 22, and by way of the guiding device of the circular-bore segment 223, the bit 31 is aligned with and pushed out of the mounting tube 22.

From above-mentioned descriptions, the screwdriver of the present invention allows to move forward and rearward by using the grip so as to automatically rotate the rotary cartridge to replace the bits, likewise, the rotary cartridge may be received in the cavity portion of the body so as to obtain the aesthetic appearance of the screwdriver.

While we have shown and described various embodiments in accordance with the present invention, it should be clear to those skilled in the art that further embodiments may be made without departing from the scope of the present invention.

What is claimed is:

1. A screwdriver with rotary cartridge including replaceable bits therein comprising:

a body including a receiving portion, a front end of said body is provided with a mounting tube for communicating with the receiving portion, and a rear end of said body is provided with a slide seat for communicating with the receiving portion;

a rotary cartridge pivotally disposed in the receiving portion of the body and including at least one groove for receiving bits, and the at least one groove being rotatable to correspond to the mounting tube, and an end surface at one end of the rotary cartridge is provided with a plurality of locking protrusions;

a grip mounted on the rear end of the body, having a push shank at a front end of said grip, with the push shank being fitted in the slide seat, alignable with the at least one groove, and the mounting tube;

a slidable piece attached in the receiving portion and including a guide slot affixed thereon, at a rear end of the slidable piece is connected the grip, with the push shank actuating the slidable piece to slide;

an actuation member axially disposed on one end of a rotating shaft and including a guiding tab for being fitted in the guide slot of the slidable piece, with the slidable piece actuating the locking protrusions to rotate.

2. The screwdriver with rotary cartridge including replaceable bits therein as claimed in claim 1, wherein the rotary cartridge includes a retaining slot mounted on the outer surface thereof, and the slidable piece includes a resilient piece fixed thereon, and the resilient piece includes a retaining boss in response to the retaining slot so as to bias against the rotary cartridge.

3. The screwdriver with rotary cartridge including replaceable bits therein as claimed in claim 1, wherein said rotary cartridge is axially secured in a receiving member, and the receiving member is received in the receiving portion.

4. The screwdriver with rotary cartridge including replaceable bits therein as claimed in claim 3, wherein a front end of said receiving member has a through opening corresponding to the mounting tube at the front end of the body, and a rear end of said receiving member has a through opening corresponding to the slide seat at the rear end of the body.

5. The screwdriver with rotary cartridge including replaceable bits therein as claimed in claim 1, wherein between said push shank of the grip and said slide seat is formed a confining structure.

6. The screwdriver with rotary cartridge including replaceable bits therein as claimed in claim 5, wherein said confining structure includes a recess defined at a front end of said push shank and having a stop plane formed at the front end thereof and a guide plane formed at the rear end thereof, on said slide seat is arranged a confining chamber in which a limiting member for being retained in the recess of said push shank is received.

7. The screwdriver with rotary cartridge including replaceable bits therein as claimed in claim 6, wherein said limiting member includes a locking portion for resiliently locking with the recess and includes a hooking portion for hooking with the slidable piece so that as the push shank pushes the limiting member, the slidable piece is actuated to slide frontward and rearward.

8. The screwdriver with rotary cartridge including replaceable bits therein as claimed in claim 1, wherein on the end surface of one end of the rotary cartridge are mounted a plurality of locking protrusions, each having an inclined plane formed thereon so as to lock with the actuation member.

9. The screwdriver with rotary cartridge including replaceable bits therein as claimed in claim 1, wherein said mounting tube at the front end of the body includes a ratchet block fixed around the outer periphery thereof.

10. The screwdriver with rotary cartridge including replaceable bits therein as claimed in claim 1, wherein said mounting tube of the body includes a polygon-bore segment arranged at the front end thereof, and a circular-bore segment formed at the rear end thereof and having a guiding device.

11. The screwdriver with rotary cartridge including replaceable bits therein as claimed in claim 10, wherein said guiding device at the rear end of the mounting tube includes a hole provided in said mounting tube and not passing through said circular-bore segment, said hole includes a ball mounted therein by an annular piece such that said ball resiliently extends into said circular-bore segment and corresponds to the flat position of said polygon-bore segment.

* * * * *